US005784074A

United States Patent [19]

Okawa

[11] Patent Number: 5,784,074

[45] Date of Patent: Jul. 21, 1998

[54] IMAGE OUTPUT SYSTEM AND METHOD

[75] Inventor: Tetsuya Okawa, Tokyo, Japan

[73] Assignee: Sega Enterprises, Ltd., Tokyo, Japan

[21] Appl. No.: 440,826

[22] Filed: May 15, 1995

[30] Foreign Application Priority Data

May 17, 1994 [JP] Japan ..... 6-102980
May 17, 1994 [JP] Japan ..... 6-103070

[51] Int. Cl.[6] ..... G09G 5/36

[52] U.S. Cl. ..... 345/515; 345/509; 345/516; 345/202; 345/203

[58] Field of Search ..... 345/213, 200, 345/202, 123, 509, 516, 515

[56] References Cited

U.S. PATENT DOCUMENTS

| | | | |
|---|---|---|---|
| 4,434,472 | 2/1984 | Kachun | 345/200 |
| 4,594,587 | 6/1986 | Chandler et al. | 345/200 |
| 4,611,228 | 9/1986 | Machida et al. | 345/213 |
| 4,788,540 | 11/1988 | Tokumitsu et al. | 345/213 |
| 5,122,789 | 6/1992 | Ito | 345/518 |
| 5,185,603 | 2/1993 | Medin | 345/213 |
| 5,289,575 | 2/1994 | Godfrey | 345/200 |
| 5,371,518 | 12/1994 | Hannah | 345/213 |
| 5,563,633 | 10/1996 | Parsons | 345/202 |

FOREIGN PATENT DOCUMENTS

| | | |
|---|---|---|
| 2304486 | 12/1990 | Japan . |
| 468864 | 3/1992 | Japan . |
| 4291424 | 10/1992 | Japan . |
| 557062 | 3/1993 | Japan . |
| 5324784 | 12/1993 | Japan . |

*Primary Examiner*—Richard A. Hjerpe
*Assistant Examiner*—Kent Chang
*Attorney, Agent, or Firm*—Price, Gess & Ubell

[57] ABSTRACT

An image output system and method which outputs high-resolution, high-quality images, while using a limited amount of frame memory. A CPU 1 reads and executes a program stored in a ROM 2, and writes image data, read from the ROM 2 or obtained by calculating data contained in the ROM 2, into a frame memory 6. The image data stored in the frame memory consists of length values and color data for the pixels to be displayed on an output screen. By storing image data according to length values and color data, the amount of data to be stored in the frame memory is reduced. The image data stored in the frame memory 6 is converted to the image display signal for each pixel, based upon length values and color data. The image display signal is then sent to the image display system 14 via the video signal generation means 13. An image that is displayed on an image output system can be changed by merely changing a length value in the image data read from the frame memory, without having to change the contents of image data stored in the frame memory, which reduces the amount of required hardware.

8 Claims, 15 Drawing Sheets

| | 0 | 1 | 2 | 3 | n | END |
|---|---|---|---|---|---|---|
| LINE 0 | A0 | A1 | A2 | A3 | An | |
| LINE 1 | B0 | B1 | B2 | B3 | Bn | |
| LINE 2 | C0 | C1 | C2 | C3 | Cn | |
| LINE N | N0 | N1 | N2 | N3 | Nn | |
| LINE 255 | | | | | | |

FIG. 11a

| ADDRESS | DATA (WORD) |
|---|---|
| 0 | BA0 |
| 1 | BA0 |
| 2 | BA0 |
| 3 | BA0 |

FIG. 11b

| | 0 | 1 | 2 | 3 | 4 |
|---|---|---|---|---|---|
| LINE 0 | A0 | A1 | A2 | A3 | A4 |
| LINE 1 | A0 | A1 | A2 | A3 | A4 |
| LINE 2 | A0 | A1 | A2 | A3 | A4 |
| LINE 3 | A0 | A1 | A2 | A3 | A4 |

FIG. 12a

| ADDRESS | DATA |
|---|---|
| 0 | BA3 |
| 1 | BA2 |
| 2 | BA1 |
| 3 | BA0 |

FIG. 12b

| | 0 | 1 | 2 | 3 | 4 |
|---|---|---|---|---|---|
| LINE 0 | D0 | D1 | D2 | D3 | D4 |
| LINE 1 | D0 | D1 | D2 | D3 | D4 |
| LINE 2 | D0 | D1 | D2 | D3 | D4 |
| LINE 3 | D0 | D1 | D2 | D3 | D4 |

FIG. 13a

| ADDRESS | DATA |
|---|---|
| 0 | BA1 |
| 1 | BA2 |
| 2 | BA3 |
| 3 | BA4 |

FIG. 13b

| | 0 | 1 | 2 | 3 |
|---|---|---|---|---|
| LINE 0 | B0 | B1 | B2 | B3 |
| LINE 1 | C0 | C1 | C2 | C3 |
| LINE 2 | D0 | D1 | D2 | D3 |
| LINE 3 | E0 | E1 | E2 | E3 |

FIG. 14a

| ADDRESS | DATA |
|---|---|
| 0 | BAN |
| 1 | BA0 |
| 2 | BA1 |
| 3 | BA2 |

FIG. 14b

| | 0 | 1 | 2 | 3 |
|---|---|---|---|---|
| LINE 0 | N0 | N1 | N2 | N3 |
| LINE 1 | A0 | A1 | A2 | A3 |
| LINE 2 | B0 | B1 | B2 | B3 |
| LINE 3 | C0 | C1 | C2 | C3 |

FIG. 15a

| ADDRESS | DATA |
|---|---|
| 0 | BA0+1 |
| 1 | BA1+1 |
| 2 | BA2+1 |
| 3 | BA3+1 |

FIG. 15b

| | 0 | 1 | 2 | 3 |
|---|---|---|---|---|
| LINE 0 | A1 | A2 | A3 | A4 |
| LINE 1 | B1 | B2 | B3 | B4 |
| LINE 2 | C1 | C2 | C3 | C4 |
| LINE 3 | D1 | D2 | D3 | D4 |

FIG. 16a

| ADDRESS | DATA |
|---|---|
| 0 | BA0−1 |
| 1 | BA1−1 |
| 2 | BA2−1 |
| 3 | BA3−1 |

FIG. 16b

| | 0 | 1 | 2 | 3 |
|---|---|---|---|---|
| LINE 0 | A_ | A0 | A1 | A2 |
| LINE 1 | B_ | B0 | B1 | B2 |
| LINE 2 | C_ | C0 | C1 | C2 |
| LINE 3 | D_ | D0 | D1 | D2 |

FIG. 17a

| ADDRESS | DATA |
|---|---|
| 0 | AB0 |
| 1 | AB0 |
| 2 | AB1 |
| 3 | AB1 |
| 4 | AB2 |
| 5 | AB2 |

FIG. 17b

| | 0 | 1 | 2 | 3 |
|---|---|---|---|---|
| LINE 0 | A0 | A1 | A2 | A3 |
| LINE 1 | A0 | A1 | A2 | A3 |
| LINE 2 | B1 | B1 | B2 | B3 |
| LINE 3 | B0 | B1 | B2 | B3 |
| LINE 4 | C0 | C1 | C2 | C3 |
| LINE 5 | C0 | C1 | C2 | C3 |

FIG. 18a

| ADDRESS | DATA |
|---|---|
| 0 | BA0 |
| 1 | BA2 |
| 2 | BA4 |
| 3 | BA6 |
| 4 | BA8 |
| 5 | BA10 |

FIG. 18b

| | 0 | 1 | 2 | 3 |
|---|---|---|---|---|
| LINE 0 | A0 | A1 | A2 | A3 |
| LINE 1 | C0 | C1 | C2 | C3 |
| LINE 2 | E0 | E1 | E2 | E3 |
| LINE 3 | G0 | G1 | G2 | G3 |
| LINE 4 | I0 | I1 | I2 | I3 |
| LINE 5 | K0 | K1 | K2 | K3 |

FIG. 20a

DISPLAY SCREEN

| | | | | |
|---|---|---|---|---|
| A | A | A | A | A |
| B | A | A | A | A |
| B | B | A | A | A |
| B | B | B | A | A |
| B | B | B | B | A |

NUMBER OF PIXELS = 25

PRIOR ART

FIG. 20b

BIT-MAPPED MEMORY LAYOUT

| | | | | |
|---|---|---|---|---|
| A | A | A | A | A |
| B | A | A | A | A |
| B | B | B | A | A |
| B | B | B | A | A |
| B | B | B | B | A |

NUMBER OF MEMORY UNITS USED = 25

PRIOR ART

FIG. 20c

RUN LENGTH MEMORY LAYOUT

| | | | |
|---|---|---|---|
| 4 | A | | |
| 0 | B | 3 | A |
| 1 | B | 2 | A |
| 2 | B | 1 | A |
| 3 | B | 0 | A |

NUMBER OF MEMORY UNITS USED = 18

PRIOR ART

IMAGE OUTPUT SYSTEM AND METHOD

BACKGROUND OF THE INVENTION

1. Field of the Invention

This invention relates to an image output method and to an image output system suitable for implementing the method. More specifically, this invention relates to a technique which reduces the amount of frame memory to be used and enables the screen to be scrolled, enlarged, and reduced with a limited amount of memory and without having to provide a special piece of hardware.

2. Description of the Prior Art

A variety of image output systems for use on a video entertainment system and a personal computer have been introduced, including Japanese Non-Examined Patent Publication No. 4-291424, Japanese Non-Examined Patent Publication No. 4-45488, Japanese Non-Examined Patent Publication No. 5-57062, and Japanese Non-Examined Patent Publication No. 5-324784.

In general, an image output system for use on a video entertainment system and other devices comprises a frame memory where image data is stored, one frame at a time, and a video display processor (VDP) which generates RGB signals by reading image data from the frame memory in synchronization with the horizontal and vertical synchronous signals.

In this type of system, the CPU reads image data, such as still image data or animation data to be displayed on the screen of the display, from a ROM and writes it into frame memory as a program progresses. Image data, once written into a frame memory, is read in synchronization with the horizontal and vertical synchronous signals from the VDP, converted to analog signals by the D/A converter in the VDP, and sent to a display as the RGB signals for display on the screen.

Basically, a system according to the prior art has a configuration shown in FIG. 19. That is, in FIG. 19, 91 is a CPU which controls the overall system, 92 is a ROM unit where video entertainment programs and display data are stored, 93 is a command input means such as a control pad which is connected to the CPU 91 via an I/O port 94, and 95 is a CPU interface which connects the CPU 91 to an image output system. The image output system has a memory swap switch 96 controlled by the CPU 91, frame memory units 97 where image data is stored, one frame at time, and a video display processor (VDP) 98 which reads image data from the frame memory 97 in synchronization with the horizontal and vertical synchronous signals and outputs it as the RGB signal. The output of the VDP is connected to a display 99 such as a CRT display.

In an image output system according to the prior art which has the configuration described above, the CPU 91 executes a video entertainment program stored in the ROM 92 and, as the program progresses, writes image data, such as still image data or animation data, to be displayed on the screen of the display 99 into the frame memory 97 via the CPU interface 95 and the memory swap switch 96. Image data written into the frame memory 97 is read in synchronization with the horizontal and vertical synchronous signals from the VDP 98, converted to analog signals with the D/A converter in the VDP 98, and then sent to the display 99 as RGB signals for display on the screen.

In this type of image output system, image data to be displayed on the display 99 is written into the frame memory 97, one screen at a time, in the bit-mapped mode. For example, as shown in FIG. 20 (*a*), suppose that the number of pixels on the display screen of the display 99 is 25 and that this display screen is composed of color A and color B. In this case, as shown in FIG. 20(*b*), the position and the color of each pixel is recorded such that there is a one-to-one correspondence between pixels on the screen of the display 99 and the pixels in the frame memory 97.

Another known method is a cell mapped method in which there is no one-to-one pixel correspondence between the frame memory and the display screen; instead, the screen is divided into squares or rectangles, each consisting of a specified number of pixels which consists data unit, and information on the position and color for each data unit is recorded.

Problems to Be Solved by the Invention

However, in the bit-mapped method or cell-mapped method, the address of the top-left corner on the screen is specified, and the screen is displayed according to each pixel data address which is calculated relative to the address of the top-left corer. Therefore, when part of the screen is scrolled or when part of the screen is displayed in the reversed display, an address calculation circuit specifically designed for each function is required.

For example, when only area A of the screen is scrolled as shown in FIG. 21 (*a*), an address in area B is calculated as usual but, for an address in area A, special calculation for scrolling is required. In addition, when the area above and the area below of area D are displayed in the reversed display as shown in FIG. 21 (*b*), addition is performed for an address in areas C and E and subtraction is performed for an address in area D.

Because the address of pixel data to be scrolled or displayed in reversed display must be calculated for each function as described above, the circuit becomes more complex.

Writing image data into the frame memory 97 with a one-to-one correspondence with all pixels on the display 99 as described above, requires a large amount of frame memory. In addition, recent video entertainment systems and other computers, which have high-resolution displays, requires more frame memory.

In a system according to the prior art which writes image data from the ROM 92 into the frame memory 97, image data representing a transformed image stored in the ROM 92 and image data corresponding to a transformed image obtained through calculation based on data stored in ROM 92 as well as data already stored in the frame memory 97 must be re-written even when an image on the screen is enlarged, reduced, rotated, changed, or moved. This re-write operation increases the load on the CPU, slowing down the image display speed.

As a program becomes larger, the number of colors increases, and the resolution of an image becomes higher, the amount of data that must be stored in the ROM 92 increases. To solve this problem, a variety of methods arc known which compress these data and keep them in the ROM 92. The run length method is one of these data compression methods. In this method, when a series of pixels of the same color are to be displayed consecutively on the screen of the display 99, data is compressed based on data on the color and the number of the consecutive pixels of the color (length of data of the same color). Thus, the amount of data is reduced when compared with that in a conventional method in which data about the color for each pixel must be saved.

However, an image output system according to a prior art uses a data decompression system, to de-compress data stored in the ROM 92 by the method such as the run length method, back to one-screen bit-mapped image data and then writes resulting data into the frame memory 97. This means that, though the ROM 92 contains less data, the frame memory 97 must be as large as that in a system which does not use de-compressed data, and the amount of memory cannot be reduced.

Specifically, before changing or rotating an image, compressed data is decompressed into bit-mapped data and then written into the frame memory to reduce the load on the CPU. This is because calculation on compressed data is complex. However, even though not all but only some image data need be rotated or changed, all compressed data must be de-compressed into bit-mapped data, increasing the amount of frame memory.

SUMMARY OF THE INVENTION

This invention seeks to solve the problems associated with the prior art described above. A first object of this invention is to provide an image output system of a simple configuration with a less amount of frame memory.

A second object of this invention is to provide an image output system capable of outputting high-resolution, high-quality images with a less amount of frame memory in a simple configuration.

A third object of this invention is to provide data de-compression means for de-compressing image data read from frame memory into image display signals based on the length value and color data.

A forth object of this invention is to provide an image output system capable of changing images to be displayed according to image data read from frame memory.

A fifth object of this invention is to provide an image output system capable of outputting high-quality images in a simple configuration.

A sixth object of this invention is to provide an image output method of outputting high-resolution, high-quality images with a less amount of frame memory.

A seventh object of this invention is to provide an image output method of changing display images simply by the simple method as changing the length value of image data without having to re-write image data in the frame memory.

A eighth object of this invention is to provide an image output method of displaying data, on a pixel basis, only on images to be changed or rotated, as in the bit-mapped method, when image data must be displayed in the bit-mapped method to change or rotate images.

A ninth object of this invention is to provide an image output method of high-quality images without providing a special piece of hardware.

A tenth object of this invention is to provide an image output method of outputting images with a less amount of data when the same line is displayed repeatedly.

A eleventh object of this invention is to provide an image output method of exchanging lines without having to re-write image data.

A twelfth object of this invention is to provide an image output method of scrolling images without having to provide a special piece of hardware.

A thirteenth object of this invention is to provide an image output method of enlarging images without having to provide a special piece of hardware.

A fourteenth object of this invention is to provide an image output method of reducing images without having to provide a special piece of hardware.

The invention according to a first embodiment of the present invention is an image output system comprising: an image display system in the raster scan mode controlled by horizontal/vertical synchronous signals; frame memory into which image data are stored; a horizontal/vertical synchronous generation section for generating horizontal/vertical synchronous signal for controlling the operating timing of said image system; read means for sequentially reading pixel data from said frame memory; and a video signal generation means for outputting image display signals to said image display system based on said pixel data.

The invention according to the first embodiment causes CPU to execute a program in the ROM to write into frame memory the image data contained in the ROM on the result of calculation on the image data in the ROM. The read means reads the image data written into the frame memory as described above with the horizontal/vertical signals. The image data is output on an image display system vea the video signal generation means such as a video encoder.

The invention according to a second embodiment of the present invention is an image output system comprising: an image display system in the raster scan mode controlled by horizontal/vertical synchronous signals; frame memory into which image data composed of length values, each indicating the number of consecutive pixels of the same color to be displayed on the image display system into a scan direction, and color data are stored; a horizontal/vertical signal generation section which controls said image display system; a memory controller which controls the reading operation of image data in said frame memory in synchronization with horizontal/vertical signals; data de-compression means for outputting color data, based on a length value and color data contained in image data read from said frame memory, for the number of pixels specified by the length value; and video signal generation means for outputting image display signals, based on this data de-compression means, on said image display system.

The invention according to the second embodiment causes the CPU to execute a program in the ROM to write into frame memory the image data contained in the ROM or the result of calculation on the image data contained in the ROM. This image data consists of length values and color data. Therefore, on a display screen where there are 25 pixels consisting of color A and color B as shown in FIG. 20 (*a*), the length values, each indicating the number of consecutive pixels of the same color, and pixel colors are written as shown in FIG. 20 (*c*). As a result, whereas a system using the bit-mapped layout requires the amount of memory for 25 pixels, a system according to this invention requires the amount of memory only for 18 pixels.

The memory controller reads the image data written into the frame memory as described above in synchronization with the horizontal/vertical signals. This image data, consisting of length values and color data, cannot be displayed directly on image display systems such as a CRT. Thus, a system according to this invention uses the data de-compression means to convert this image data into an image display signal for each pixel based on the length value and color data and then outputs the image display signal on an image display system via the video signal generation means such as a video encoder.

The invention according to a third embodiment of the present invention is an image output system, wherein said data de-compression means comprises: a length counter for counting the length value of image data sent from frame memory; and a data latch circuit for outputting color data of image data during the counter operation of said length counter.

The invention according to the third embodiment causes the data de-compression means to store a length value contained in the image data into the length counter and color data into the data latch circuit when the image data read from frame memory is sent. Color data is sent, one pixel at a time, from the data latch circuit to the video signal generation means in synchronization with the horizontal/vertical synchronous signals. The length counter is decremented by the length value each time color data is output, one pixel at a time, from the data latch circuit. As a result, as many pixels as the length value are output from the data latch circuit.

The invention according to a fourth embodiment of the present invention is an image output system, wherein said data de-compression means has a length value change means for changing a length value contained in image data read from frame memory.

The invention according to the fourth embodiment causes the length value change means in the data de-compression means to change a length value contained in the image data read from the frame memory. This changes the number of pixels of the same color sent from the data de-compression means, allowing a different image to be displayed on an image display system without changing image data stored in the frame memory.

The invention according to the fifth embodiment of the present invention is an image output system comprising: an image display system in the raster scan mode controlled by horizontal/vertical synchronous signals; frame memory in which pixel data, each piece of which corresponding to a pixel, for one screen of said image display system are stored, and addresses, at which the pixel data of the first pixel on each line are stored, are set as a line table; a horizontal/vertical synchronous generation section for generating horizontal/vertical synchronous signals for controlling the operating timing of said image display system; read means for reading the addresses as a base address of each line from said line table in synchronization with horizontal/vertical synchronous signals and for sequentially reading pixel data from an address in said frame memory indicated by the base address that has been read; and a video signal generation means for outputting image display signals to said image display system according to said pixel data.

The invention based on the fifth embodiment divides the screen of an image output system and sets the base address of pixel data for each line, thus eliminating a circuit for calculating pixel data addresses and allowing high-quality images to be output without complicating the circuit.

To achieve the above objects, the invention according to a sixth embodiment of the present invention is an image output method for displaying an image in which an image display system in the raster scan mode, controlled by horizontal/vertical synchronous signals, is provided, image data to be displayed, one screen at a time, on this image display system is written into frame memory, and an image is displayed on said image display system based on image data read from this frame memory, said image output method comprising the steps of: composing said image data with length values, each indicating the number of consecutive pixels of the same color to be displayed on the image display system into a scan direction, and color data; writing the image data into frame memory; reading the image data from said frame memory in synchronization with said horizontal/vertical synchronous signals; and, displaying an image on said image display system based on length values and color data in this image data.

The invention according to the sixth embodiment causes image data to be written into frame memory without being de-compressed into the bit-mapped form; instead, it is written into frame memory in a compressed form consisting of length values and color data. Therefore, the more consecutive pixels of the same color, the less frame memory into which image data is to be written.

The invention according to a seventh embodiment of the present invention is an image output method as claimed in claim 6, wherein image data, composed of length values and color data and stored in frame memory, is read, and the shape of an image to be displayed on an image display system is changed by changing length values contained in this image data.

The invention according to the seventh embodiment changes the number of pixels of the same color on the screen by changing a length value in image data read from the frame memory. This enables an image that is displayed on an image output system to be changed without having to change the contents of image data stored in the frame memory.

The invention according to an eighth embodiment of the present invention is an image output method as claimed in claim 6, wherein image data with the length value of 1 is stored consecutively in frame memory for the number of pixels when that number of consecutive pixels of the same color are to be displayed on a part or all of image dada on one screen.

The invention according to the eighth embodiment allows data to be processed on a pixel basis, as in the bit-mapped mode, by setting the length value to 1 even when a plurality of pixels of the same color appear consecutively.

The invention according to a ninth embodiment of the present invention is an image output method for displaying an image in which an image display system in the raster scan mode, controlled by horizontal/vertical synchronous signals, is provided, image data to be displayed, one screen at a time, on this image display system is written into frame memory, and an image is displayed on said image display system based on image data read from this frame memory, said image output method comprising the steps of: storing pixel data, each piece of which corresponding to a pixel, for one screen of an image display system; storing addresses, at which the pixel data of the first pixel on each line are stored, as a line table; reading an address from the line table as the base address of each line in synchronization with the horizontal/vertical synchronous signal; reading pixel data sequentially from an address in said frame memory indicated by the base address that has been read; and displaying an image on the image display system based on this pixel data.

The invention according to the ninth embodiment divides one screen of an image output system into lines, sets the base address of pixel data for each line, and sequentially reads pixel data from the frame memory indicated by the base address. This invention allows an image to be processed, in most cases, by changing the base address, eliminating the need for a special piece of hardware.

The invention according to a tenth embodiment of the present invention is an image output method, wherein a plurality of lines, each consisting of the same pattern of pixels, are displayed by re-writing a plurality of addresses set up in the line table to the same address.

The invention according to the tenth embodiment allows the same address to be used as the base address when displaying a line consisting of the same pixel data continuously. This method reads the same pixel data repeatedly and therefore reduces the amount of data that must be stored.

The invention according to an eleventh embodiment of the present invention is an image output method, wherein lines displayed on image display system are exchanged by exchanging addresses set up in said line table.

The invention according to the eleventh embodiment allows lines to be exchanged by simply exchanging the associated addresses in the line table, eliminating the need to re-write pixel data.

The invention according to a twelfth embodiment of the present invention is an image output method, wherein an image to be displayed on the image display system is scrolled by sequentially shifting the addresses set up in the line table and by overwriting pixel data to be scrolled into the screen of said image display system onto pixel data to be scrolled off the screen of said image display system.

The invention according to the twelfth embodiment shifts the addresses in the line table into the scroll direction when scrolling the screen and writes into frame memory only the pixel data to be scrolled into the screen. At this time, since pixel data to be scrolled off the screen is overwritten by the pixel data to be scrolled into the screen, only one screen of frame memory is required.

The invention according to a thirteenth embodiment of the present invention is an image output method, wherein an image to be displayed on said the image display system is enlarged by re-writing addresses set up in the line table so that the same address is repeated for the specified number of times.

The invention according to the thirteenth embodiment repeats the same address in the line table the number of times consecutively according to an enlargement ratio to enlarge an image.

The invention according to a fourteenth embodiment of the present invention is an image output method, wherein an image to be displayed on the image display system is reduced by creating said line table by skipping addresses at a specified interval and by overwriting pixel data to be scrolled into the screen of the image display system onto pixel data to be scrolled off the screen of the image display system.

The invention according to the fourteenth embodiment changes the addresses in the line table according to a reduction ratio and overwrites the pixel data to be added on the pixel data to be removed to reduce an image.

BRIEF DESCRIPTION OF THE DRAWINGS

FIG. 4(*b*) is a diagram showing the structure of image data in frame memory in the embodiment.

FIG. 11(*a*) is a diagram showing a configuration of the frame memory 6 in the embodiment. FIG. 11(*b*) is a diagram showing a display matrix when the same line is displayed continuously in the embodiment.

FIG. 12(*a*) is a diagram showing a configuration of the frame memory 6 in the embodiment. FIG. 12(*b*) is a diagram showing a display matrix are exchanged in the embodiment.

FIG. 13(*a*) is a diagram showing a configuration of the frame memory 6 in the embodiment. FIG. 13(*b*) is a diagram showing a display matrix when the screen is scrolled up one line in the embodiment.

FIG. 14(*a*) is a diagram showing a configuration of the frame memory 6 in the embodiment. FIG. 14(*b*) is a diagram showing a display matrix when the screen is scrolled down one line in the embodiment.

FIG. 15(*a*) is a diagram showing a configuration of the frame memory 6 in the embodiment. FIG. 15(*b*) is a diagram showing a display matrix when the screen is scrolled one dot to the left in the embodiment.

FIG. 16(*a*) is a diagram showing a configuration of the frame memory 6 in the embodiment. FIG. 16(*b*) is a diagram showing a display matrix when the screen is scrolled one dot to the right in the embodiment.

FIG. 17(*a*) is a diagram showing a configuration of the frame memory 6 in the embodiment. FIG. 17(b) is a diagram showing a display matrix when an image is enlarged twice vertically in the embodiment. FIG. 18(*a*) is a diagram showing a configuration of the frame memory 6 in the embodiment. FIG. 18(*b*) is a diagram showing a display matrix when an image is reduced by one-half vertically in the embodiment.

FIGS. 20(*a*) to 20(*c*) are diagrams showing the relation between a display image and frame memory into which the data is written.

DESCRIPTION OF THE PREFERRED EMBODIMENTS

Referring to the attached drawings, there is shown a preferred embodiment of the present invention.

Figure 1:
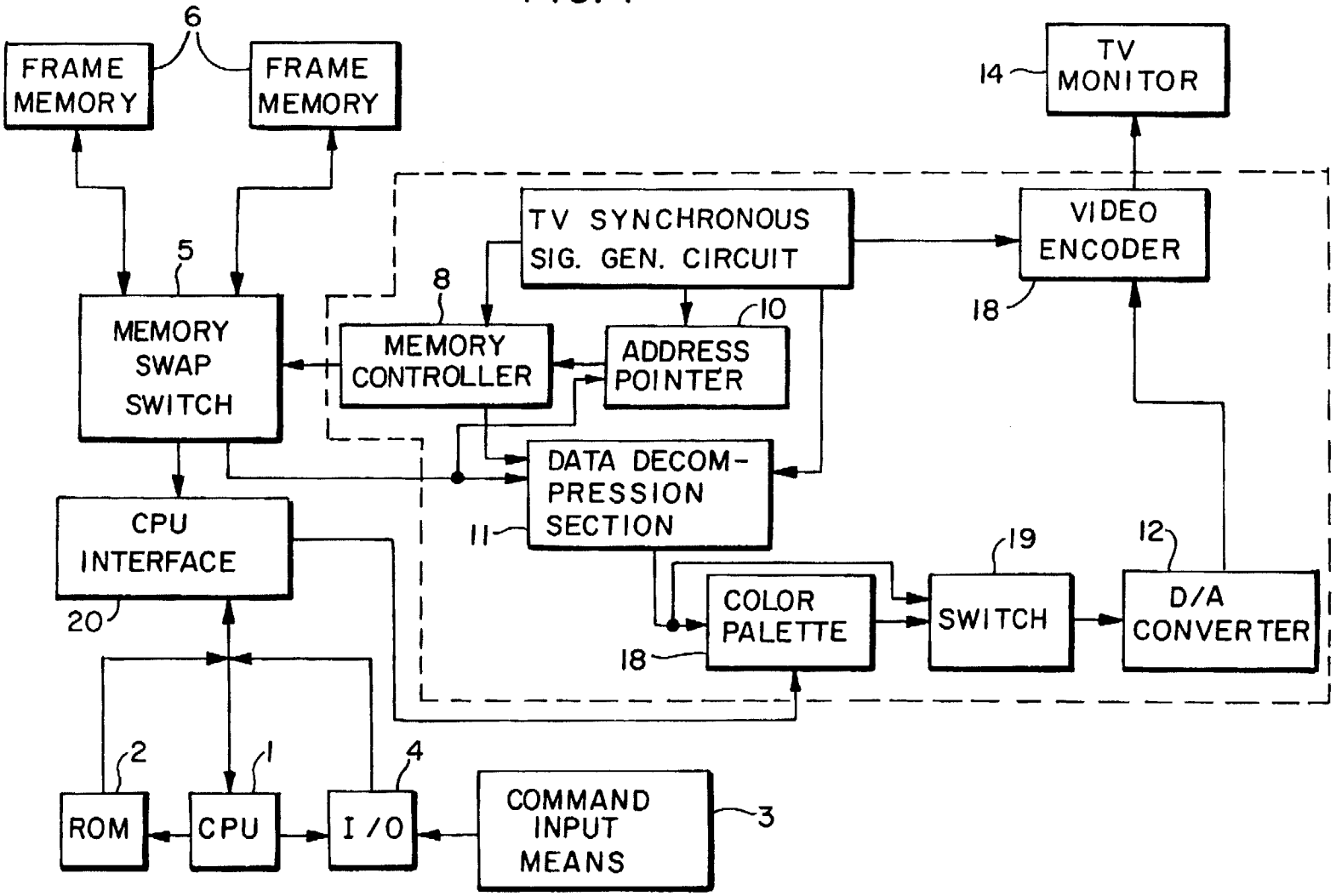
FIG. 1 is a block diagram showing the first embodiment of an image output system associated with this invention.

In FIG. 1, 1 is a CPU, 2 is ROM in which data such as a program or image data is stored, 3 is a command input means connected to the CPU 1 via the I/O port 4, and 20 is an interface through which an image output means according to this invention is connected to the CPU.

5 is a memory swap switch which is an interlocking switch. This memory swap switch switches frame memory between a plurality of frame memory units 6 and 6 provided in this embodiment, and connects one of them to the CPU interface 20 and the other to the VDP 7. This VDP 7 contains the memory controller 8 which controls the reading operation of image data from the frame memory 6, the TV synchronous signal generation circuit 9 from which the horizontal/vertical synchronous signals are sent to such image output systems as a CRT and to the memory controller 8, the address pointer 10 which indicates the address of image data to be read from the frame memory 6 and 6, the de-compression section 11 which de-compresses image data read from the frame memory 6 and 6, the D/A converter 12, and the video signal generation means 13. This video signal generation means 13 is connected to the image display system 14 provided outside the VDP 7.

An output from the data de-compression section 11 in the VDP 7 is sent to the color palette 18. The switch 19 is provided between the data de-compression section 11 and the color palette 18 to determine whether image data de-compressed by the data de-compression section 11 is to be sent to the D/A converter 12 either directly or via the color palette 18.

Figure 2:
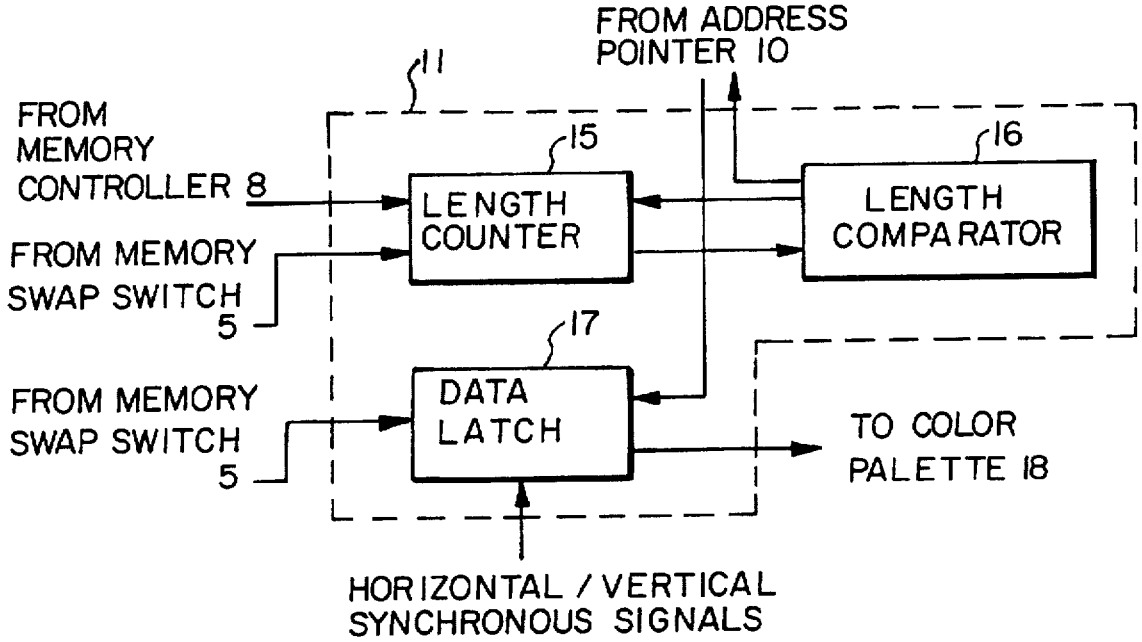
FIG. 2 is a block diagram showing the structure of the de-compression section 11 in the embodiment.
Figure 3:
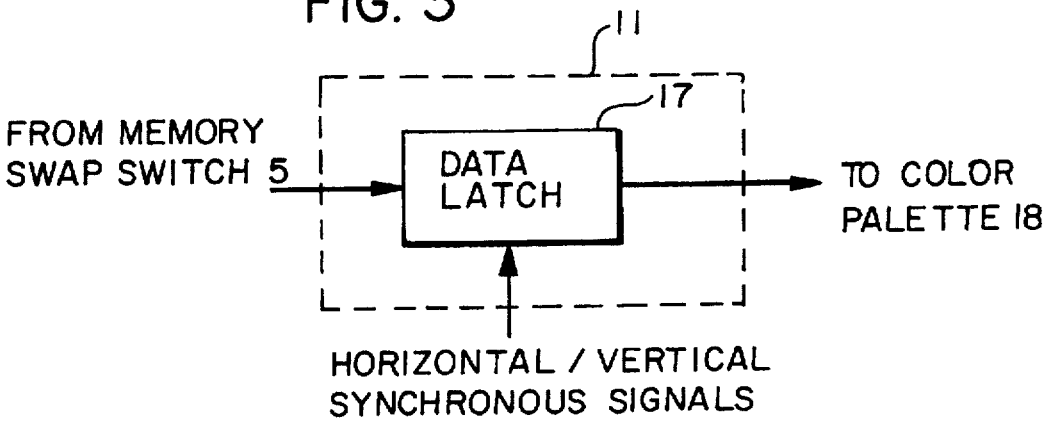
FIG. 3 is a block diagram showing the structure of the de-compression section 11 in the embodiment.

FIG. 2 and 3 show block diagrams of the data de-compression section 11. First, the following explains the case in which the the data de-compression section 11 shown in FIG. 2 is used.

The data de-compression section 11 contains the length counter 15 which gets a length value from image data, the length comparator 16 which finds a value in the length counter 15, and the data latch circuit 17 which gets color data from image data and outputs it in synchronization with the horizontal/vertical synchronous signals.

Figures 4A, 4B:
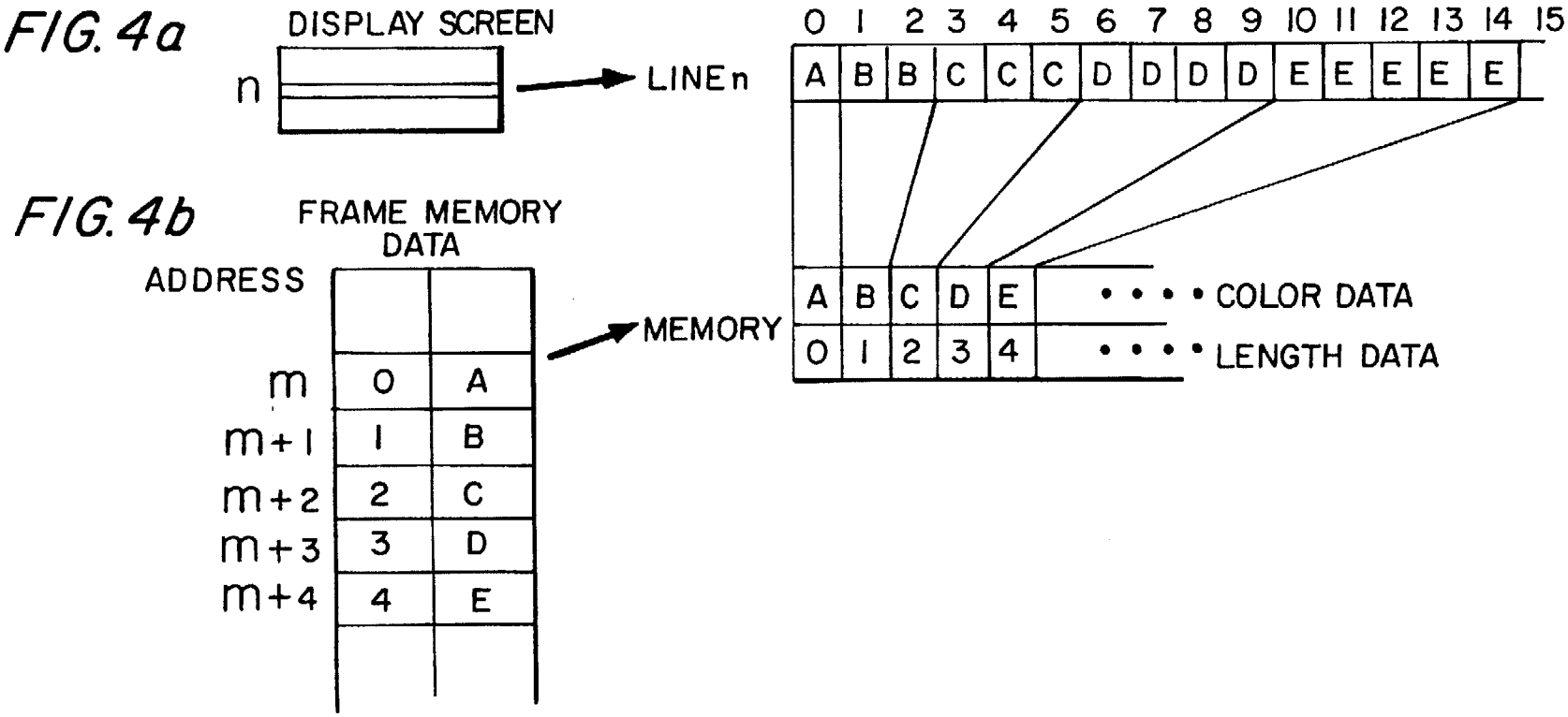
FIG. 4(*a*) is a diagram showing the structure of image data on a display screen in the embodiment.
Figure 5:
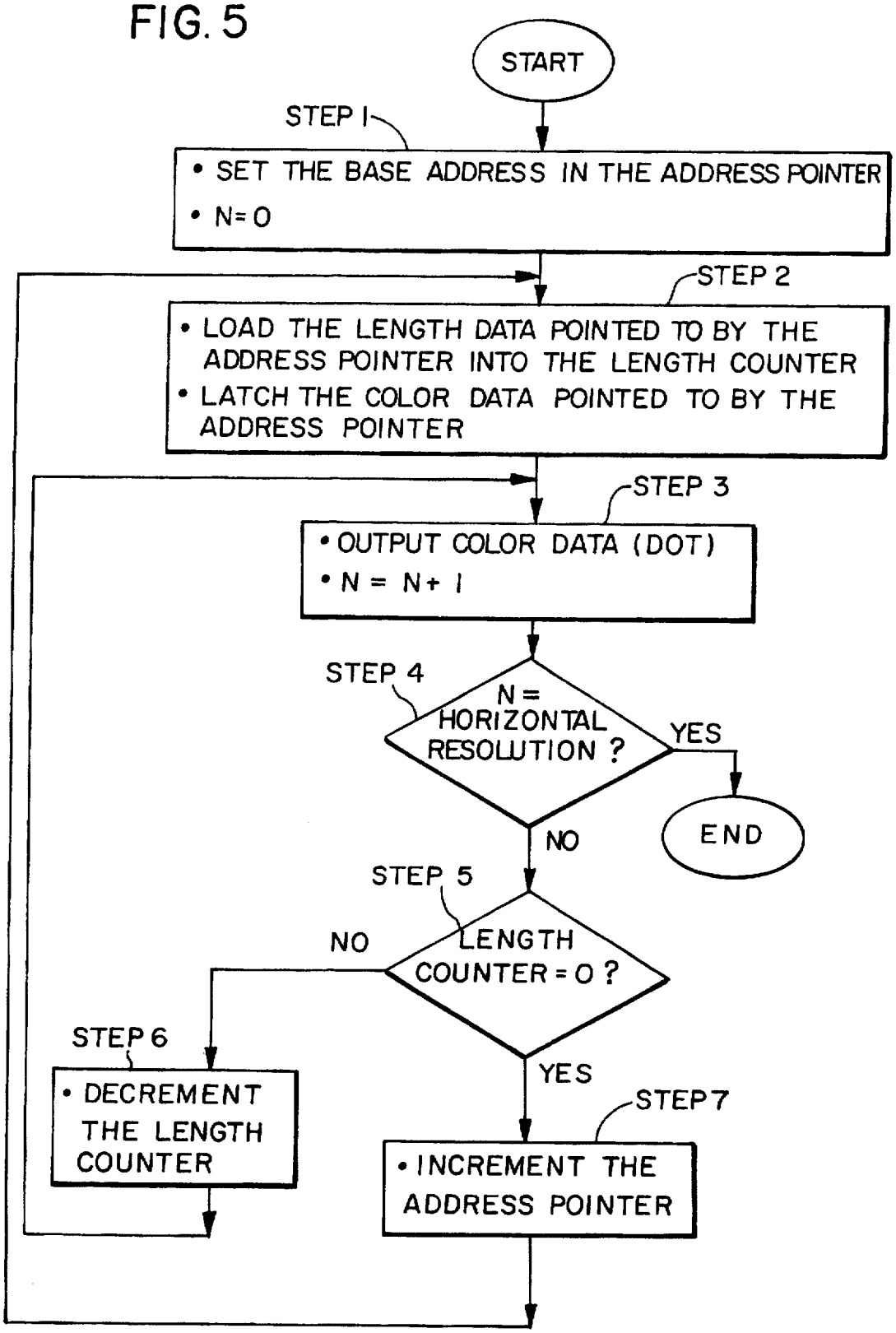
FIG. 5 is a flowchart showing the operation of data de-compression section 11 in the embodiment.

Referring to the diagram of image data written at frame memory addresses shown in FIG. 4 and to the flowchart shown in FIG. 5, the operation of this embodiment with the above configuration is described.

First, the CPU 1 reads a program from the ROM 2, such as a CD-ROM or ROM cartridge, executes it and, at the same time, writes image data contained on the ROM 2 into the frame memory 6 via the CPU interface 5. In this case, image data consists of a length value and color data; it may be stored directly on the ROM 2 or it may be calculated based on data on the ROM 2 when the image displayed is 3D image data using polygons. It may also be data on the ROM 2 on which operation has been performed by a command entered from the command input means 3 connected to the CPU 1.

When image data, for example, data on line n on an image output system shown in FIG. 4 (*a*), is written into the frame memory 6, it is stored in the frame memory 6 as shown in FIG. 4 (*b*). That is, at address m in the frame memory 6, the color data A indicating the first pixel, n0, on line n and the length value of 0 indicating the number of consecutive pixels, 1, of the color are written. At the next address, m+1, the color data B indicating the second and third pixels, n1 and n2, and the length value of 1 indicating the number of consecutive pixels, 2, of the color arc written. Similarly, at each address in the frame memory 6, the length value and the color data for pixels on each line are written.

The CPU 1 switches the memory swap switch 5 to write image data into one of two frame memory units 6 and 6. And, the VDP 7 reads data from one of two frame memory units 6 and 6 which is not selected by the CPU 1 for writing data into. Using frame memory in dual mode with the use of the memory swap switch 5 allows image data to be read and written concurrently.

After writing image data into the frame memory 6, the CPU 1 controls the memory swap switch 5 to connect the frame memory 6, into which data has been written, to the VDP 7. The TV synchronous signal generation circuit 9 in the VDP 7 sends the horizontal/vertical synchronous signals to the video signal generation means 13 for generating the image display signal and, at the same time, informs the memory controller 8 of the horizontal and vertical positions of a pixel to be displayed on the image display system 14. The memory controller 8 reads image data from the corresponding address in the frame memory 6 according to the horizontal/vertical synchronous signals.

That is, as shown in the flowchart in FIG. 5, the memory controller 8 sets the base address of the frame memory 6 in the address pointer 10 and, at the same time, sets the horizontal resolution counter to N=0 to indicate that display begins at the first pixel on the line (step 1). Then, image data is read from the address in the frame memory 6 that is set in the address pointer 10. The length value contained in this image data is stored in the length counter 15 and the color data is stored in the data latch circuit 17 (step 2). The color data on one pixel is sent from the data latch circuit 17 to the D/A converter 12 according to the display signal of each pixel sent from the TV synchronous signal generation circuit 9 (step 3).

In this case, the switch 19 switches the flow of color data according to the structure of color data of the image signal. That is, when color data may be used directly in the video signal generation means 13, output from the data latch circuit 17 is sent directly to the D/A converter 12 for use as color data. When color data from the data latch circuit 17 is an address in the color palette 18, color data corresponding to the address is sent from the color palette to the D/A converter 12.

When one-pixel of color data is output from the data latch circuit 17, the horizontal resolution counter is incremented by 1 (N=N+1 in step 3). Color data is output until N reaches the horizontal resolution, that is, until all the pixels of the line are output (step 4). That is, whenever one pixel of data is output from the data latch circuit 17, the length comparator 16 checks the length counter 15 to see if it is 0 (step 5). If it is not, it is necessary to display pixels of the same color continuously. To do so, the length value in the length counter 15 is decremented (step 6), and then control goes back to step 3 to output color data from the data latch circuit 17.

When as many pixels of the same color as the length value have been output, the output from the length counter 15 is 0. In this case, the address pointer 10 is incremented (step 7), the next image data is read from the frame memory 6, and the length value in the length counter 15 as well as the color data in the data latch circuit 17 are updated (step 2).

This process is repeated as described above, and as many pixels of the same color as the number indicated by the length value are sent from the data latch circuit 17 to the D/A converter 12. The D/A converter 12 converts this color data to the analog RGB signal. The video signal generation system 13 combines this analog RGB signal with the horizontal/vertical synchronous signals to generate the image display signal and sends it to the image display system 14.

As shown in the diagram of data structure in frame memory in FIG. 4, this embodiment reduces the amount of frame memory in which image data is stored when a plurality of pixels of the same color appear consecutively. As compared with the bit-mapped method, this embodiment significantly reduces the amount of memory required for video entertainment programs or business programs where pixels of the same color appear consecutively in the background.

On the other hand, the length value of 1 allows each pixel to be processed individually even when a plurality of pixels of the same color appear consecutively. Therefore, for a part of pixel data which must be rotated or changed, the length value of 1 is used to process data as bit-mapped data; for a part of pixel data which need not be rotated or changed, a usual length value indicating the number of consecutive pixels of the same color is used. Thus, operation on data to be rotated or changed is simplified and, at the same time, the amount of frame memory is reduced.

Figure 6:
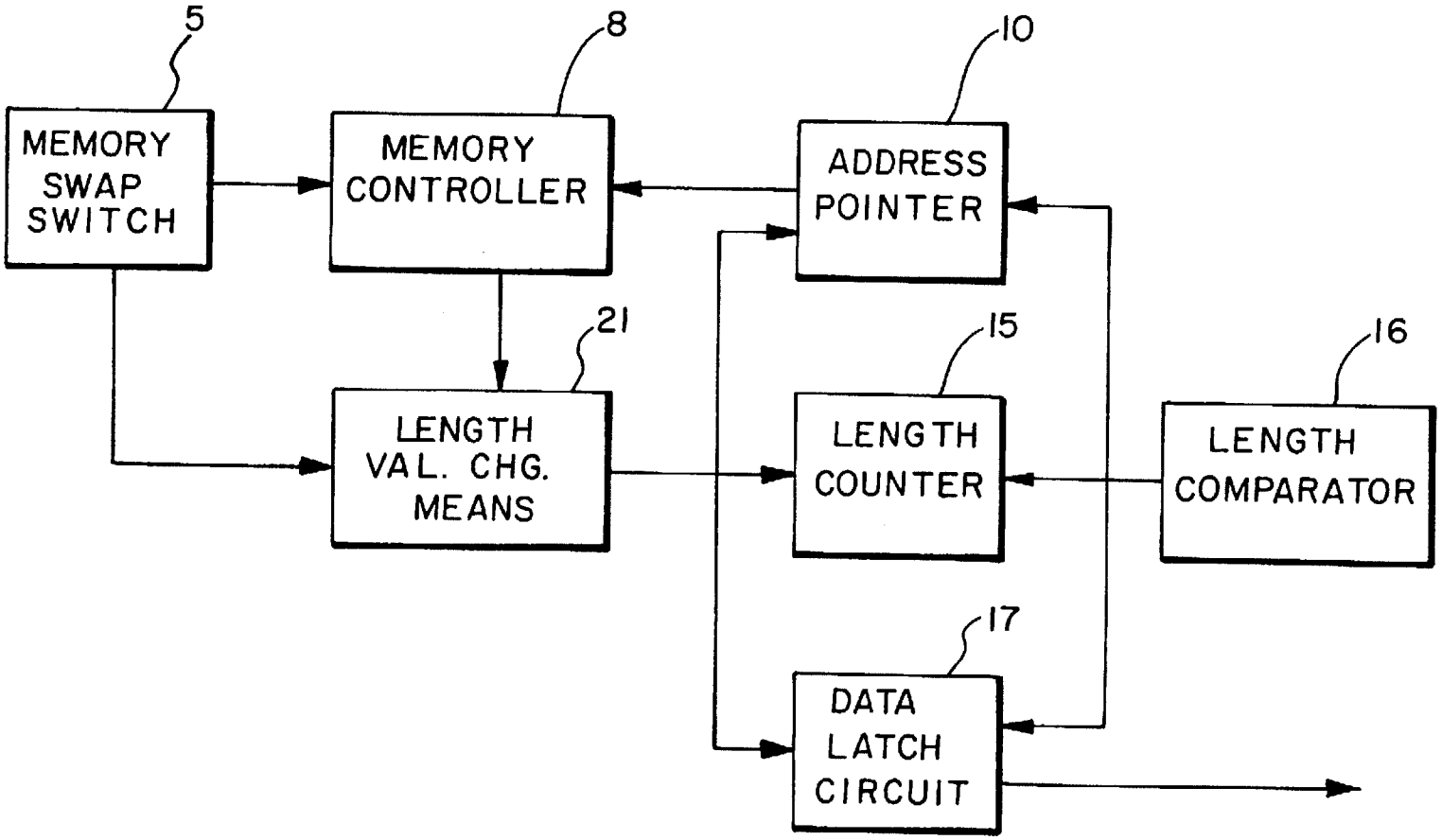
FIG. 6 is a block diagram showing another embodiment of this invention.

As shown in FIG. 6, the length value change means 21, which is controlled by the CPU 1, may be provided. It is used before length value data is sent from the frame memory 6 to the length counter 15. This length value change means 21, which is used to change the length value in pixel data read from the frame memory 6, allows the number of pixels of the same color sent from the data latch circuit 17 to be changed freely, making it possible to change the shape of an image to be displayed on the image display system 14 without having to re-write the contents of the frame memory 6.

Then, the following explains the case in which the data de-compression section 11 shown in FIG. 3 is used. In this case, the frame memory units 6 and 6 store pixel data, one screen (frame) at a time. And pixel data consists of color data specifying the color of a dot on the display screen.

The following explains how an image output system in this embodiment with the above configuration operates.

Figures 7, 8:
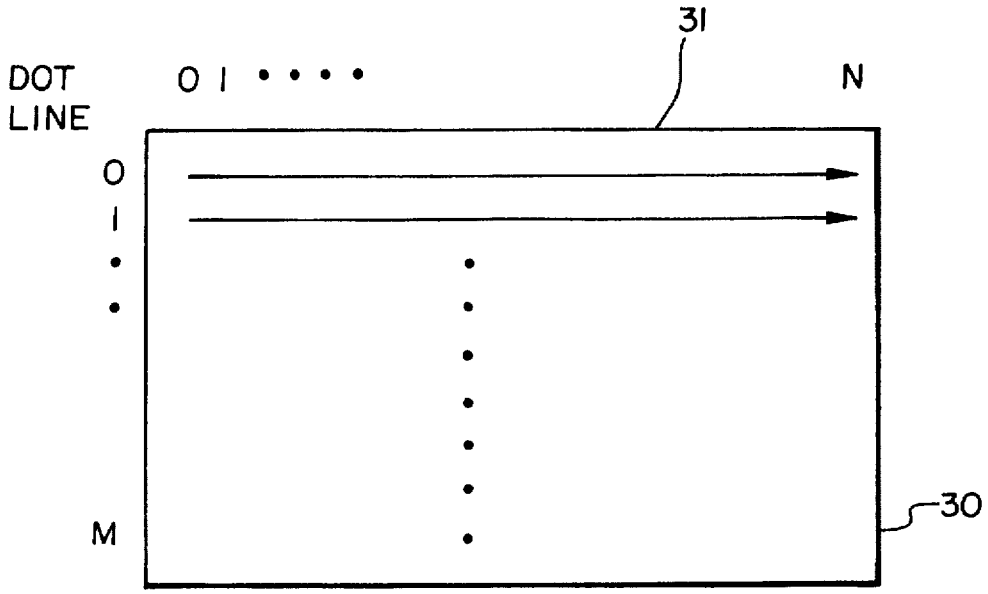
FIG. 7 is a diagram explaining the display screen 30 in the embodiment.
FIG. 8 is an example of a display matrix of a display screen in the embodiment.

In general, when an image is displayed on the display screen 30 of the TV monitor 14, as shown in FIG. 7, one screen (screen) consists of many lines 31, 31, . . . from the top-left corner to the bottom-right corner. In the following discussion, suppose that the number of lines 31, 31, . . . on one screen is M and that the number of pixels on each line 31 is N.

Figure 9:
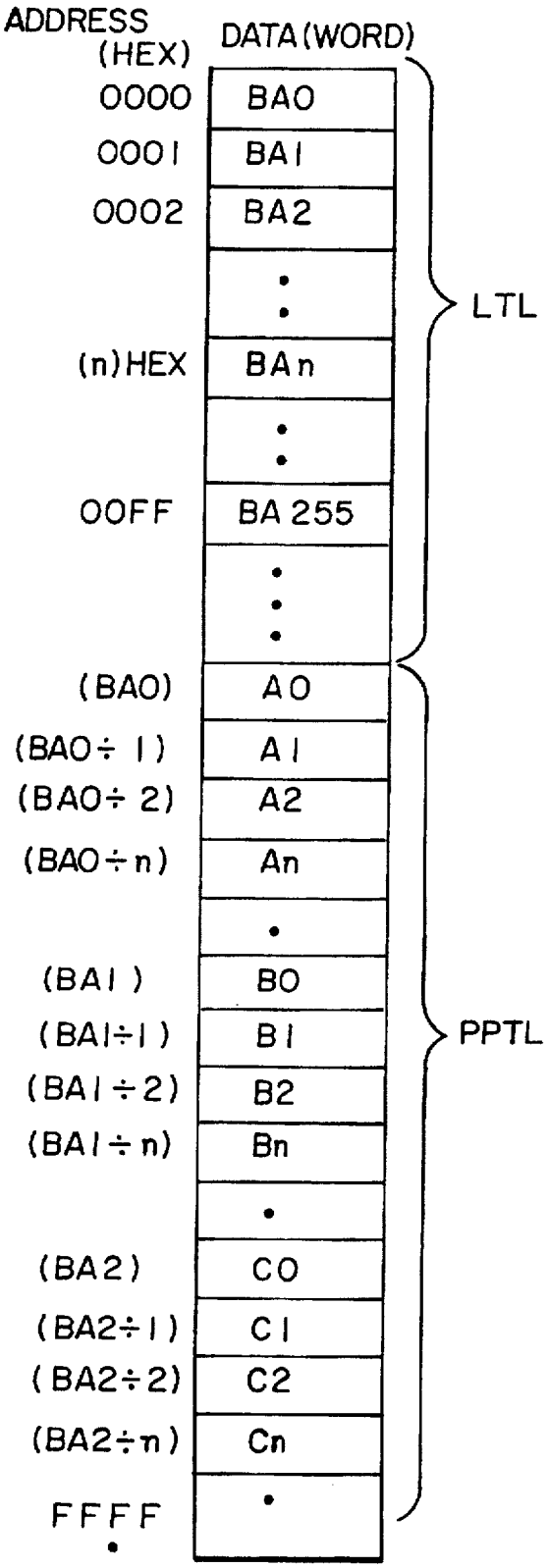
FIG. 9 is a diagram showing an example of a configuration of frame memory configuration used in the embodiment.

FIG. 8 shows a display screen represented in the display matrix form. In this case, image data is written into the frame memory 6 as shown in FIG. 9. The frame memory 6 consists of the pixel data table PDTL and the line table LTL. Addresses BA0, BA0+1, BA0+2, . . . in the pixel data table PDTL indicates memory addresses, and pixel data corresponding to each pixel on the display screen is stored at each address. Addresses 0000, 0001, 0002, . . . in the line table correspond to lines 0, 1, 2, . . . N on the display screen and, at each address in the line table, the address in the pixel data table PDTL at which pixel data to be used for the first pixel on a line is stored (hereafter called a start address).

For example, pixel data A0 indicating the first pixel on line 0 is stored at address BA0 in the pixel data table PDTL in the frame memory 6, pixel data A1 indicating the second pixel on line 0 is stored at the next address BA0+1, and so on. Similarly, pixel data for each line is stored at each address in the pixel data table PDTL in the frame memory 6.

In addition, address BA0 of pixel data A0 that is the first pixel on line 0 is stored at address 0000 in the line table, and address BA1 of the first pixel on line 1 is stored at address 0001. Similarly, the start address of each line is stored at each address in the line table LTL in the frame memory 6.

Figure 10:
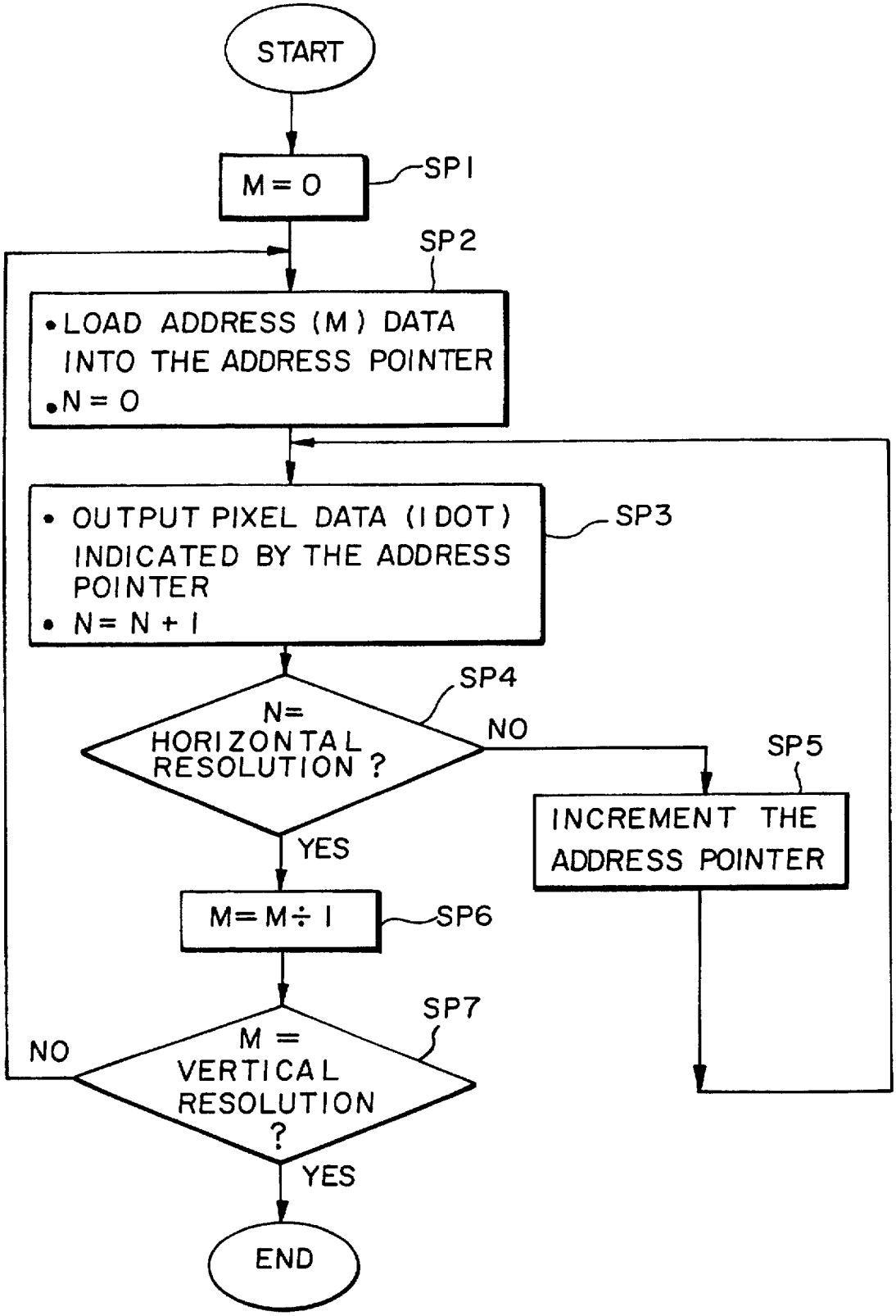
FIG. 10 is a flowchart showing the display processing in the embodiment.
Figure 19:
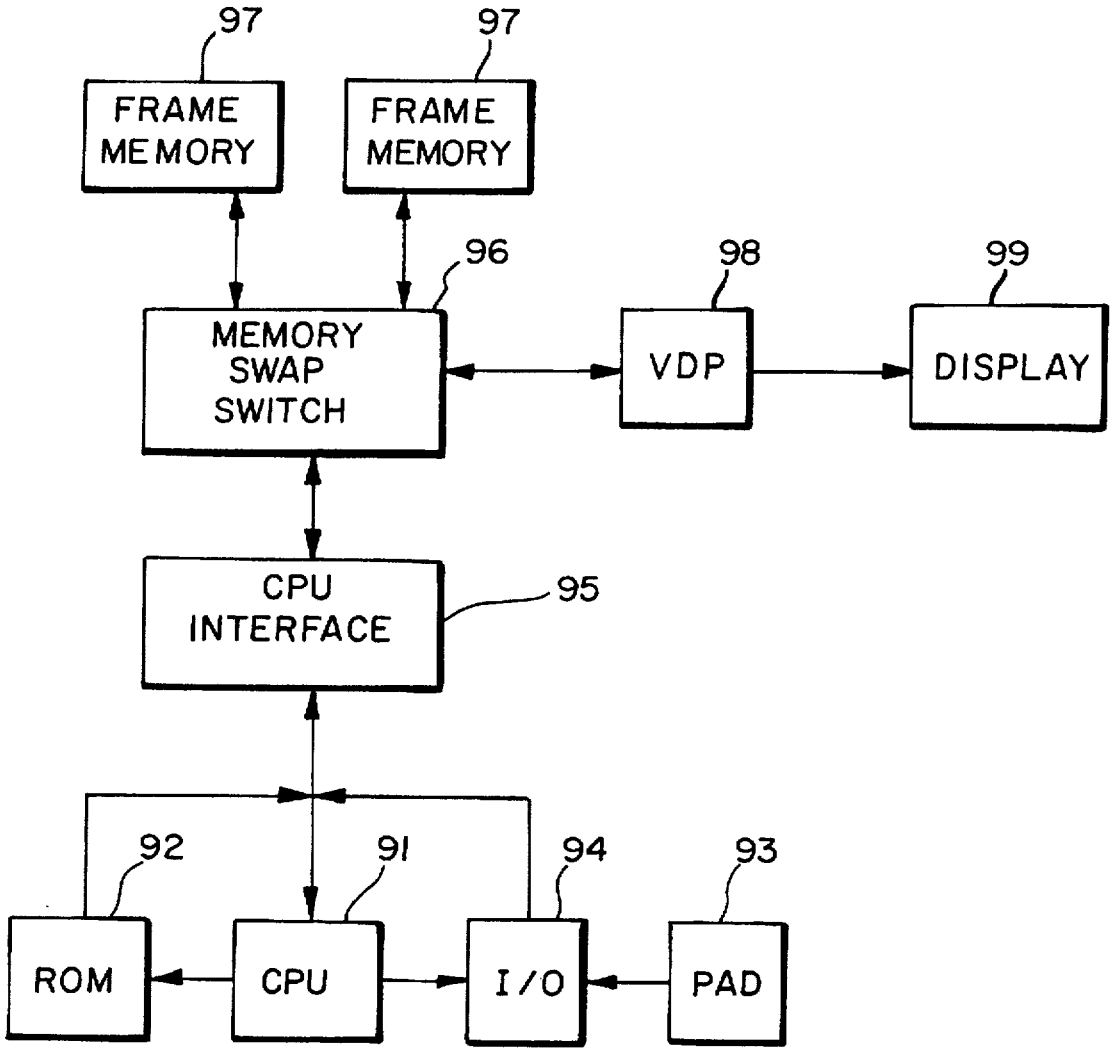
FIG. 19 PRIOR ART
FIG. 19 is a block diagram showing an example of a conventional image output system.
Figure 21A:
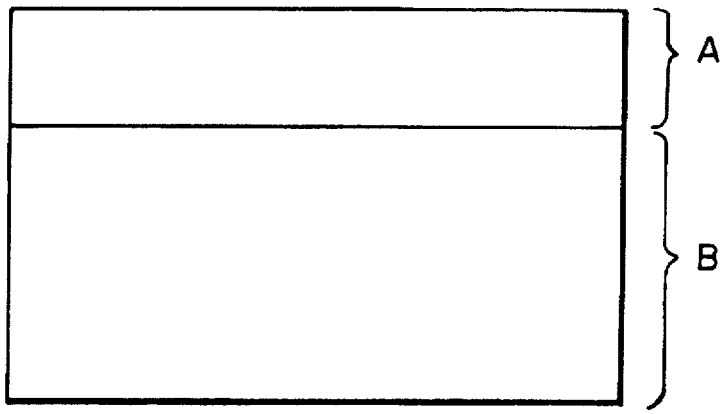
FIG. 21a PRIOR ART
FIGS. 21(*a*) and 21(*b*) are diagrams showing the problems with a conventional image output system.
Figure 21B:
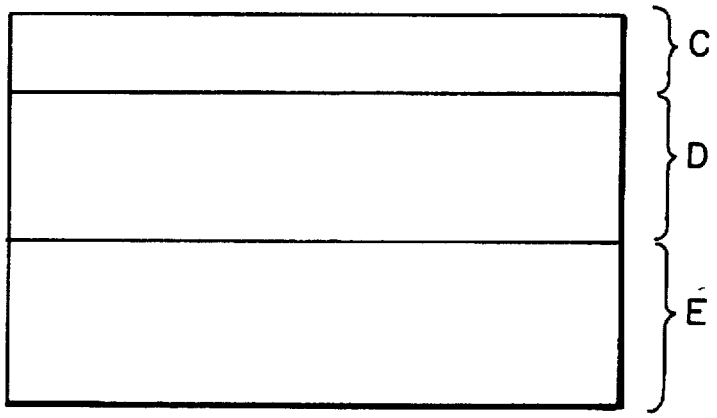
FIG. 21b PRIOR ART

Display processing for each frame will be explained particularly with reference to the flowchart in FIG. 10.

First, the memory controller 8 sets 0 in the vertical resolution counter M in step SP1.

Then, in step SP2, the memory controller 8 reads data, corresponding to the value in counter M, from the line table LTL in the frame memory 6, and sets it in the address pointer 10. At this time, when counter M contains 0, the address "BA0" that is stored at address 0000 in the line table LTL is set in the address pointer 10. In step SP2, 0 is set in the horizontal resolution counter N.

Then, in step SP3, the memory controller 8 generates a signal used to read pixel data, stored at address pointed to by address pointer 10, from the frame memory 6. This read signal is supplied to the frame memory 6 via the memory swap switch 5. This causes the corresponding pixel data to be sent to the data latch circuit 17 via the memory swap switch 5, and to be output in synchronization with the dot clock signal CK from the TV synchronous signal generation circuit 9. When the address pointer 10 contains the address "BA0", one dot of pixel data "A0" is read.

In this case, the switch 19 switches the flow of color data according to the structure of pixel data of the image signal. That is, when pixel data may be used directly in the video encoder 13, output from the data latch circuit 17 is sent directly to the D/A converter 12 for use as pixel data. When pixel data from the data latch circuit 17 is an address in the color palette 18, palette data corresponding to the address is sent to the D/A converter 12.

When one pixel of data is output from the data latch circuit 17, the counter N is incremented in step SP3. And, in step SP4, a check is made to see if the value in the counter N equals the horizontal resolution, that is, if all the pixel data on the line has been read. If the result is "NO", control is passed to step SP5 and the memory controller 8 increments the address that is set in the address pointer 10. If the address pointer 10 contains "BA0", the address is set to "BA0+1". Then, control returns to step SP3 to repeat the pixel data output from the data latch circuit 17.

When one line of pixel data has been read, the value of the counter N equals the horizontal resolution and, therefore, the result is "YES" in step SP4. Control is passed to step SP6, and the counter M is incremented.

Then, in step SP7, a check is made to see if the value in the counter M equals the vertical resolution. If the result is "NO", that is, one frame of pixel data is not yet read, control returns to step SP2.

In step SP2, the memory controller 8 reads data at the address in the line table LTL, indicated by the counter M, from the frame memory 6, and sets it in the address pointer 10. When the counter M contains 1, data "BA1" at address "0001" in the line table LTL is set in the address pointer 10. In step SP2, 0 is set in the counter N. Steps SP3 to SP5 are repeated as described above to output pixel data from the data latch circuit 17.

Steps SP2 to step SP7 are repeated until one frame of pixel data has been read. When the value in the counter M equals the vertical resolution, the result in the step SP7 is "YES" and processing is terminated.

Pixel data or palette data sent to the D/A converter 12 is converted to the analog video signal, which is then sent to the video encoder 13. The video encoder 13 generates the image display signal based on the above analog video signal and supplies it to the TV monitor 14 in synchronization with the dot clock signal from the TV synchronous signal generation circuit 9. An image is displayed on the TV monitor 14 according to the above pixel data.

<Repeated Display of the Same Line>

The following explains how the line 31, consisting of a particular combination of pixel data, is repeated. Here, line 0 shown in FIG. 8 is displayed continuously. In this case, the CPU 1 re-writes the line table LTL as shown in FIG. 11 (*a*). That is, the CPU 1 stores the start address of line 0 at addresses 0001, 0002, 0003, . . . in the line table LTL.

This sets the address "BA0" in the address pointer 10, causing pixel data starting at address BA0 to be read repeatedly. FIG. 11 (*b*) shows the display matrix.

A line patterned after line 0 is displayed continuously.

<Exchange of Lines>

The following explains how lines are exchanged. Here, lines 0 to 3 on the display screen shown in FIG. 8 are exchanged with lines 3 to 0.

In this case, the CPU 1 re-writes the line table LTL as shown in FIG. 12 (*a*). That is, the CPU 1 stores "BA3" indicating the start address of line 3 at address 0000 in the line table LTL, "BA2" indicating the start address of line 2 at address 0001, "BA1" indicating the start address of line 1 at address 0002, and "BA0" indicating the start address of line 0 at address 0003. This will cause the screen, such as the one shown in the display matrix in FIG. 12 (*b*), to be displayed.

<Scrolling>

The following explains how the screen is scrolled.

To scroll up the screen one line, the CPU 1 re-writes the line table LTL as shown in FIG. 13 (*a*). That is, CPU 1 stores at address 0000 the start address "BA1" at address 0001 in the line table LTL shown in FIG. 8 and, at address 0001, the start address "BA2" at address 0002 in the line table LTL in FIG. 8. Similarly, at the next address, the CPU 1 stores the start address of the line that was immediately below. Only for the bottom line, the CPU 1 stores pixel data in the pixel data table PDTL. In this case, data is written at and after the start address BA0 of the line that was scrolled off. The CPU 1 stores the start address BA0 at address 00FF in the line table LTL. This will cause the screen, such as the one shown in the display matrix in FIG. 13 (*b*), to be displayed.

To scroll down the screen one line, the CPU 1 re-writes the line table LTL as shown in FIG. 14 (*a*). That is, CPU 1 stores at address 0001 the start address "BA0" at address 0000 in the line table LTL shown in FIG. 9 and, at the next address, the stores the start address of the line that was immediately above. Only for the top line, the CPU 1 stores pixel data in the pixel data table PDTL. In this case, data is written at and after the start address BAN of the line that was scrolled off. The CPU 1 stores the start address BAN at address 0000 in the line table LTL. This will cause the screen, such as the one shown in the display matrix in FIG. 14 (*b*), to be displayed.

To scroll the screen to the left one dot, the CPU 1 re-writes the line table LTL as shown in FIG. 15 (*a*). That is, the CPU 1 adds 1 to all the start addresses and, only for the right-most pixel data, stores pixel data in the pixel data table PDTL. In this case, data is written at the address where the left-most pixel data was stored. For example, on line 0, the CPU 1 stores pixel data at address BA0 in the pixel data tape PDTL shown in FIG. 8. This will cause the screen, such as the one shown in the display matrix in FIG. 15 (*b*), to be displayed.

To scroll the screen to the right one dot, the CPU 1 re-writes the line tale LTL as shown in FIG. 16 (*a*). That is, the CPU 1 subtracts 1 from all the start addresses and, only for the left-most pixel data, stores pixel data in the pixel data table PDTL. In this case, data is written at the address where the right-most pixel data was stored. For example, on line 0, the CPU 1 stores pixel data at address BA0+N in the pixel data table PDTL shown in FIG. 9. This will cause the screen, such as the one shown in the display matrix in FIG. 16 (*b*), to be displayed.

<Enlargement>

The following explains how an image is enlarged. Here, the display screen shown in FIG. 8 is vertically enlarged twice.

In this case, the CPU 1 re-writes the line table LTL as shown in FIG. 17 (*a*). That is, CPU 1 stores the start address "BA0", which was stored at address 0000, at addresses 0000 and 0001 in the line table LTL, and the start address "BA1", which was stored at address 0001, at addresses 0002 and 0003. Similarly, it stores the same start address at two consecutive addresses. This will cause the screen, such as the one shown in the display matrix in FIG. 17 (*b*), to be displayed.

<Reduction>

The following explains how an image is reduced. Here, the display screen shown in FIG. 8 is vertically reduced to one-half.

In this case, the CPU 1 re-writes the line table LTL as shown in FIG. 18 (*a*). That is, the CPU 1 stores the start address "BA2", which was stored at address 0002, at address 0001 in the line table LTL, and the start address "BA4", which was stored at address 0004, at addresses 0002. Similarly, it stores, at each address, the start address of the line that was two lines below the current line in the original screen. And, for the pixels which will appear as a result of reduction, the CPU 1 stores pixel data in the pixel data table PDTL. In this case, data is stored at and after the start address of a line that will not be displayed (In this example, addresses BA1, BA3, BA5, . . . ). The CPU 1 stores the start address in the line table LTL. This will cause the screen, such as the one shown in the display matrix in FIG. 18 (*b*), to be displayed.

As described above, when a plurality of lines consisting of the same pixel data are displayed consecutively, only pixel data for those lines need be stored and, therefore, the amount of data is reduced. To exchange lines or to enlarge or reduce an image vertically, only the addresses in the line table LTL need be re-written.

In addition, when the screen is scrolled vertically, only the pixel data for display on a line that will appear as a result of scrolling need be stored; for other lines, the addresses in the line table LTL are shifted into the scroll direction. In this case, because new pixel data may be over-written at the address where the pixel data of a line to be scrolled off was stored, continuous scrolling can be done with only one-screen memory.

The preferred embodiment described herein is not restrictive. It may be used not only on a video entertainment system but also on an image output system to be used with a personal computer and other computers.

Effect of the Invention

As described above, this invention makes it possible to provide an image output method and system which reduces the amount of required frame memory by storing image data, which is composed of a length value and color data, in the frame memory and which enables images to be changed or rotated speedily without an additional load on the CPU. An image output system according to this invention has pixel data corresponding to the pixels on one screen of an image output system as well as a line table in which the address of the first pixel data on each line is stored. Thus, continuous display of the same line, exchange of lines, scrolling of an image, or enlargement or reduction of an image does not require a special piece of hardware such as a calculation circuit and makes it possible to output high-quality images with one-screen memory.

What is claimed is:

1. An image output system comprising:

an image display system in a raster scan mode controlled by horizontal/vertical synchronous signals;

a frame memory into which image data composed of length values each indicating the number of consecutive pixels of the same color to be displayed on the image display system in a scan direction and color data are stored;

a horizontal/vertical signal generation section which controls said image display system;

a memory controller which controls the reading operation of image data in said frame memory in synchronization with horizontal/vertical signals;

data de-compression means for outputting color data, based on a length value and color data contained in image data read from said frame memory for the number of pixels specified by the length value; and video signal generation means for outputting image display signals, based on this data de-compression means, to said image display system;

wherein said data de-compression means comprises:

a length counter connected to said frame memory for counting the length value of image data sent from frame memory; and a data latch circuit for receiving color data of image data from said frame memory and outputting color data of image data to said video signal generation means during the counter operation of said length counter.

2. An image output system as claimed in claim 1, wherein said data decompression means has a length value change means for changing a length value contained in an image data read from frame memory.

3. An image output method for displaying an image in which an image display system in the raster scan mode, controlled by horizontal/vertical synchronous signals, is provided, one screen at a time, image data to be displayed, the image data is written into frame memory, and an image is displayed on said image display system based on image data read from this frame memory, said image output method comprising the steps of:

storing pixel data, each piece of pixel data corresponding to a pixel, for one screen of an image display system, said one screen of an image display system having a plurality of lines;

storing addresses of a first pixel for each line of said screen in a line table;

reading an address from said line table as the base address of each line in synchronization with said horizontal/vertical synchronous signal;

reading pixel data sequentially from an address in said frame memory indicated by the base address that has been read; and displaying image on said image display system based on this pixel data, wherein a plurality of lines, each consisting of the same pattern of pixels are displayed by re-writing a plurality of addresses set up in said line table to the same address.

4. An image output method for displaying an image in which an image display system in the raster scan mode, controlled by horizontal/vertical synchronous signals, is provided, one screen at a time, image data to be displayed, the image data is written into frame memory, and an image is displayed on said image display system based on image data read from this frame memory, said image output method comprising the steps of:

storing pixel data, each piece of pixel data corresponding to a pixel, for one screen of an image display system, said one screen of an image display system having a plurality of lines;

storing addresses of a first pixel for each line of said screen in a line table;

reading an address from said line table as the base address of each line in synchronization with said horizontal/vertical synchronous signal;

reading pixel data sequentially from an address in said frame memory indicated by the base address that has been read; and displaying image on said image display system based on this pixel data, wherein lines displayed on said image display system arc exchanged by exchanging addresses set up in said line table.

5. An image output method for displaying an image in which an image display system in the raster scan mode, controlled by horizontal/vertical synchronous signals, is provided, one screen at a time, image data to be displayed, the image data is written into frame memory, and an image is displayed on image display system based on image data read from this frame memory, said image output method comprising the steps of:

storing pixel data, each piece of pixel data corresponding to a pixel, for one screen of an image display system, said one screen of an image display system having a plurality of lines;

storing addresses of a first pixel for each line of said screen in a line table;

reading an address from said line table as the base address of each line in synchronization with said horizontal/vertical synchronous signal;

reading pixel data sequentially from an address in said frame memory indicated by the base address that has been read; and displaying image on said image display system based on this pixel data, wherein an image to be displayed on said image display system is scrolled by sequentially shifting the addresses set up in said line table and by overwriting pixel data to be scrolled into the screen of said image display system onto pixel data to be scrolled off the screen of said image display system.

6. An image output method for displaying an image in which an image display system in the raster scan mode, controlled by horizontal/vertical synchronous signals, is provided, one screen at a time, image data to be displayed, the image data is written into frame memory, and an image is displayed on said image display system based on image data read from this frame memory, said image output method comprising the steps of:

storing pixel data, each piece of pixel data corresponding to a pixel, for one screen of an image display system, said one screen of an image display system having a plurality of lines;

storing addresses of a first pixel for each line of said screen in a line table;

reading an address from said line table as the base address of each line in synchronization with said horizontal/vertical synchronous signal;

reading pixel data sequentially from an address in said frame memory indicated by the base address that has been read; and displaying image on said image display system based on this pixel data, wherein an image to be displayed on said image display system is enlarged by re-writing addresses set up in said line table so that the same address is repeated for the specified number of times.

7. An image output method for displaying an image in which an image display system in the raster scan mode, controlled by horizontal/vertical synchronous signals, is provided, one screen at a time, image data to be displayed, the image data is written into frame memory, and an image is displayed on said image display system based on image data read from this frame memory, said image output method comprising the steps of:

storing pixel data, each piece of pixel data corresponding to a pixel, for one screen of an image display system, said one screen of an image display system having a plurality of lines;

storing addresses of a first pixel for each line of said screen in a line table;

reading an address from said line table as the base address of each line in synchronization with said horizontal/vertical synchronous signal;

reading pixel data sequentially from an address in said frame memory indicated by the base address that has been read; and displaying image on said image display system based on this pixel data, wherein an image to be displayed on said image display system is reduced by creating said line table by skipping addresses at a specified interval and by overwriting pixel data to be scrolled into the screen of said image display system onto pixel data to be scrolled off the screen of said image display system.

8. An image data processing system for storing compressed image data and driving a display with the compressed image data in correlation with a horizontal/vertical synchronous display signal, comprising:

means for compressing image data representative of pixel positions that can be displayed as scan lines on a video display as length values, each length value indicating the number of consecutive pixels of the same color to be displayed;

a frame memory for storing image data;

means for writing the compressed image data into the frame memory in correlation with the horizontal/vertical synchronous display signal wherein addresses of pixel data of the first pixel data of each scan line is stored as a line table and subsequent pixel data of each scan line is stored in a pixel data table correlated with the stored addresses of the line table;

a memory controller for reading image data from the frame memory in correlation with the horizontal/vertical synchronization signal, including a horizontal resolution counter and a vertical resolution counter, whereby increments of the horizontal resolution counter causes color data for a scan line to be output until all pixels of a scan line are output while incrementing of the vertical resolution counter sets the address of the line table; and means for de-compression of the image data read by the memory controller to enable a driving of the display.

* * * * *